US007584055B2

(12) United States Patent
Parfitt

(10) Patent No.: US 7,584,055 B2
(45) Date of Patent: Sep. 1, 2009

(54) CORE SAMPLE ORIENTATION

(75) Inventor: Richard Parfitt, Kingston (GB)

(73) Assignee: Australian Mud Company, Ltd., Osborne Park, West Australia (AU)

( * ) Notice: Subject to any disclaimer, the term of this patent is extended or adjusted under 35 U.S.C. 154(b) by 0 days.

(21) Appl. No.: 10/594,355

(22) PCT Filed: Sep. 5, 2005

(86) PCT No.: PCT/AU2005/001344

§ 371 (c)(1),
(2), (4) Date: Jul. 5, 2007

(87) PCT Pub. No.: WO2006/024111

PCT Pub. Date: Mar. 9, 2006

(65) Prior Publication Data

US 2007/0282533 A1 Dec. 6, 2007

(30) Foreign Application Priority Data

Sep. 3, 2004 (AU) ..... 2004905021

(51) Int. Cl.
*G06F 19/00* (2006.01)
*E21B 25/16* (2006.01)

(52) U.S. Cl. ..... 702/9; 175/44

(58) Field of Classification Search ..... 702/9, 702/2, 11, 1, 127, 141, 145, 150–154; 175/44, 175/45, 58; 166/255.2, 255.1
See application file for complete search history.

(56) References Cited

U.S. PATENT DOCUMENTS 3,618,221 A * 11/1971 Robinson ..... 33/544
3,875,796 A * 4/1975 Gilliard ..... 73/170.32
4,128,134 A * 12/1978 Gregory ..... 175/44

(Continued)

FOREIGN PATENT DOCUMENTS

CA 2 456 506 1/2005

OTHER PUBLICATIONS

Skopec et al., Horizontal Core Acquisition and Orientation for Formation Evaluation, Sep. 1990, SPE Annual Technical Conference, New Orleans.*

(Continued)

*Primary Examiner*—Michael P. Nghiem
*Assistant Examiner*—Toan M Le
(74) *Attorney, Agent, or Firm*—Merchant & Gould P.C.

(57) ABSTRACT

A core orientation device (10) for a core drill (12). The device (10) includes an arrangement (14) for providing signals (16) associated with a physical orientation (18) of the core orientation device (10). Processing device (22) are provided for processing the signals (16) so as to provide processed data (23) from which a measure (24) of the physical orientation (18) of the core orientation device (10) can be established. The measure (24) is associated with the physical orientation (18) of the device (10) at a particular moment in time. A memory (26) is coupled to the processing device 22 for storing the processed data 23. To this end there is provided an interface means (27) including first means (28) for storing the processed data (23) in the memory (26) and second device (30) for accessing the memory (26) to provide the measure (24) of the physical orientation (18) of core orientation device (10) when required.

23 Claims, 6 Drawing Sheets

U.S. PATENT DOCUMENTS

| | | | | | |
|---|---|---|---|---|---|
| 4,311,201 | A * | 1/1982 | Stewart et al. | 175/44 |
| 4,389,792 | A * | 6/1983 | Fuchs | 33/304 |
| 4,765,414 | A * | 8/1988 | Moore | 175/44 |
| 4,883,131 | A * | 11/1989 | Foster | 175/44 |
| 5,048,619 | A * | 9/1991 | Leaney et al. | 175/40 |
| 5,052,502 | A * | 10/1991 | Jurgens et al. | 175/80 |
| 5,105,894 | A | 4/1992 | Enderlin | 175/44 |
| 5,310,013 | A * | 5/1994 | Kishino et al. | 175/44 |
| 6,006,844 | A * | 12/1999 | Van Puymbroeck et al. | 175/50 |
| 6,082,453 | A * | 7/2000 | Bakke | 166/240 |
| 6,412,575 | B1 * | 7/2002 | Harrigan et al. | 175/20 |
| 6,592,875 | B1 * | 7/2003 | McMichael | 424/234.1 |
| 6,659,196 | B1 * | 12/2003 | Anderson | 175/44 |
| 6,732,818 | B2 * | 5/2004 | Gregory | 175/58 |
| 6,871,410 | B1 * | 3/2005 | Le Jeune | 33/313 |
| 7,296,638 | B2 * | 11/2007 | Beach et al. | 175/44 |
| 2004/0036474 | A1 * | 2/2004 | Clerc | 324/377 |

OTHER PUBLICATIONS

Storms, M. A., Ocean Drilling Program (ODP) Deep Sea Coring Techniques, 1990, Marine Geophysical Researches 12, pp. 109-130.*

Bleakly et al., Controlling Errors Minimizes Risk and Cost in Core Orientation, Dec. 2, 1985, Oil & Gas Journal, pp. 103-109.*

Derwent Abstract Accession No. 2001-180537/18, RU 2160821 C2 (Pilot Res Prodn Enterp) Dec. 20, 2000.

* cited by examiner

CORE SAMPLE ORIENTATION

FIELD OF THE INVENTION

This invention relates to core sample orientation. More particularly, the invention relates to an orientation device for providing an indication of the orientation of a core sample relative to a body of material from which the core has been extracted, and also to a method of core sample orientation identification.

BACKGROUND ART

There is a need for core sampling in geological surveying operations.

Core samples are obtained through core drilling operations. Core drilling is typically conducted with a core drill comprising outer and inner tube assemblies. A cutting head is attached to the outer tube assembly, so that rotational torque applied to the outer tube assembly is transmitted to the cutting head. A core is generated during the drilling operation, with the core progressively extending along the inner tube assembly as drilling progresses. When a core sample is acquired, the core within the inner tube assembly is fractured. The inner tube assembly and the fractured core sample contained therein, are then retrieved from within the drill hole, typically by way of a retrieval cable lowered down the drill hole. Once the inner tube assembly has been brought to ground surface, the core sample can be removed and subjected to the necessary analysis.

Typically, the core drilling operation is performed at an angle to the vertical, and it is desirable for analysis purposes to have an indication of the orientation of the core sample relative to the ground from which it was extracted. It is therefore important that there be some means of identifying the orientation the core sample had within the ground prior to it having been brought to the surface.

Core orientation devices are used to provide an indication of the orientation of the core sample.

One common way of obtaining an indication of the orientation of a core sample is through use of an orientation spear comprising a marker (such as a crayon) projecting from one end of a thin steel shank, the other end of which is attached to a wire line.

The orientation spear is lowered down the drill hole, prior to the inner tube assembly being introduced. The marker on the orientation spear strikes the facing surface of material from which the core is to be generated, leaving a mark thereon. Because of gravity, the mark is on the lower side of the drill hole. The inner tube assembly is then introduced into the outer tube assembly in the drill hole. As drilling proceeds, a core sample is generated within the inner tube assembly. The core sample so generated carries the mark which was previously applied. Upon completion of the core drilling run and retrieval of the core sample, the mark provides an indication of the orientation of the core sample at the time it was in the ground.

There are also mechanical core orientation devices for marking a core sample prior to its extraction from the drill hole. Typically, mechanical devices are adapted to be incorporated in the inner tube assembly for marking the core. An example of such a mechanical orientation device is disclosed in WO 03/038212.

It is against this background and the problems and difficulties associated therewith that the present invention has been developed.

DISCLOSURE OF THE INVENTION

According to a first aspect of the invention there is provided a core orientation device for a core drill, the device comprising: an arrangement for providing signals associated with a physical orientation of the core orientation device; processing means for processing the signals provided by the arrangement so as to provide processed data from which a measure of the physical orientation of the core orientation device can be established, the measure being associated with the physical orientation of the device at a particular moment in time; memory for storing the processed data; and interface means having first means for storing the processed data in the memory and second means for accessing the memory to provide the measure of the physical orientation of core orientation device when required.

Most preferably the physical orientation of the core orientation device comprises a rotational orientation about an axis thereof. In these arrangements the rotational orientation is preferably about a longitudinal axis of the core orientation device. In other arrangements the physical orientation does not comprise a rotational orientation but rather comprises an angular orientation of the longitudinal axis above or below the horizontal plane. Embodiments may be proved where more than one orientation is measured. For example the physical orientation of the core orientation device may include both a rotational orientation about a longitudinal axis of the core orientation device and an angular orientation of the longitudinal axis above or below the horizontal plane.

Preferably the arrangement comprises triaxial accelerometer means. In these embodiments the triaxial accelerometer means may be advantageously housed by cushioning. The cushioning may increase in robustness outwardly. The cushioning may include an outer cushioning layer, an intermediate cushioning layer, and an inner cushioning layer which embraces the triaxial accelerometer means, with the robustness of cushioning progressively decreasing from the outer layer to the inner layer.

The triaxial accelerometer means may comprise three accelerometers arranged to determine acceleration in three orthogonal directions.

Preferably the core orientation device includes means for relating the measure of the orientation of the core orientation device with the present orientation thereof such that the core orientation device can be rotated to reflect the measure of the orientation of the core orientation device.

Preferably the core orientation device includes means for inputting the particular moment in time into the processing means and means for subsequently displaying the measure of the physical orientation of the device, the measure being associated with the physical orientation of the device at the inputted moment in time.

Preferably the core orientation device has a body in the form of a housing having at least one threaded end for being engaged by an inner tube assembly of a core drill so as to form a part thereof. When engaged by the inner tube assembly the core orientation device preferably forms a length of the inner tube assembly.

Preferably the processing means includes a timer configured for ensuring that the processing means processes signals from the arrangement over predetermined time intervals.

Preferably the processor means includes integration means for integrating signals from the arrangement over a predetermined time interval.

Preferably the core orientation device includes means for displaying the commencement of a reference time.

According to a second aspect of the invention there is provided a core drill having a core orientation device comprising: an arrangement for providing signals associated with a rotational orientation of the core orientation device; processing means for processing the signals provided by the arrangement so as to provide processed data from which a measure of the rotational orientation of the core orientation device can be established, the measure being associated with the rotational orientation of the device at a particular moment in time; memory for storing the processed data; and interface means having first means for storing the processed data in the memory and second means for accessing the memory to provide the measure of the rotational orientation of core orientation device when required; wherein the core drill comprises: means for maintaining knowledge of the relative rotational orientation of a core drilled by the core drill and the core orientation device such that a measure of the rotational orientation of the core can be established using the measure of the rotational orientation of the core orientation device.

Preferably the means for maintaining knowledge of the relative rotational orientation of the core drilled by the core drill comprises a mechanism for preventing rotational movement about the length of the core sample, relative to the core orientation device.

Preferably the core orientation device includes means for relating the measure of the orientation of the core orientation device with the present orientation thereof such that the core orientation device can be rotated to reflect the measure of the orientation of the core orientation device.

Preferably the core drill includes an outer tube assembly and an inner tube assembly with the inner tube assembly having a means for accommodating the core orientation device along the length of the inner tube assembly. Preferably inner tube assembly includes a bearing allowing the means for accommodating the core orientation device to rotate relative to the outer tuber assembly but not relative to the core sample when the core is received by the inner tube assembly.

Preferably the outer tube assembly includes a spacer for allowing the inner tube assembly to be fitted with the outer tube assembly, when the core orientation device is accommodated. The core drill may accordingly comprise a retrofitted core drill.

Preferably the core orientation device is cylindrical and one end of the core orientation device includes display and input means. The display means preferably comprises and LCD display and the input preferably comprises a keypad. Most advantageously the end of the core orientation device is preferably protected by the inner tube assembly when accommodated.

According to a third aspect of the invention there is provided a method of obtaining and orientating a core sample comprising:

moving a core drill having a core orientation device from a first location to a drilling location and thereafter operating the core drill to drill a core sample;

generating signals associated with a physical orientation of the core orientation device between the first location and the drilling location;

processing the signals to provide processed data from which a measure of orientation of the core orientation device at the drilling location can be established; and storing the processed data in memory such that the measure of the physical orientation of the core orientation device can be obtained therefrom.

Preferably the method includes maintaining knowledge of the relative physical orientation of the core orientation device and the core sample after the core sample has been drilled such that a measure of the orientation of the core sample taken by the core drill can be provided using the measure of the orientation of the core orientation device, when at a location spaced from the drilling location.

Preferably the method includes initialising the orientation of the core orientation device at the first location, said initialising being performed by commencing said generating and processing the signals at the first location with the core orientation device in a known orientation.

Preferably the location spaced from the drilling location is the first location and the measure of the orientation of the core orientation device is provided by maintaining the same relative orientation of the core orientation device and core sample after the core sample has been taken.

Preferably the method includes displaying a related measure of the orientation of the device and varying that measure upon rotation of the core sample and device such that a user can position the core sample and device in the measured orientation for marking.

In preferred embodiments of the invention the arrangement comprises three accelerometers operating on respective axes. The signals provided by the arrangement accordingly comprise acceleration signals which are associated with the physical orientation of the core orientation device. In these embodiments the processing means preferably processes the signals to provide data representative of the change in orientation of the core orientation device over a plurality of predetermined time intervals. The interface means operates to store the changes in orientation in the memory.

By keeping track of the time taken to move the core drill to a core sample site and commence drilling, which may occur several kilometers below sea level, the operator, is preferably able to readily access the memory of the device, one raised to the surface, to provide a measure of the orientation of the core orientation device when aligned with the core sample, and thus thereby obtain a measure of the orientation of the core sample.

Dip in exploration drilling is an important measure in the geological analysis of core samples. Often dip is measured in degrees above or below the horizontal plane. Preferably the processing means processes the signals provided by the arrangement to provide processed data from which a measure of the orientation of the core orientation device relative to the horizontal plane can be established. Rotational orientation is also an important measure.

Preferably the processing means includes an analog to digital converter for converting the signals provided by the accelerometers.

Preferably core orientation device include a body that is adapted to be coupled to a tubular core drill for drilling the core sample. In these arrangements the processed data stored in the memory is preferably derived from signals associated with movement of the body of the core orientation device.

The processing means preferably includes timer means for determining predetermined intervals relative to a reference time, and means for storing the processed data in the memory upon each of the predetermined intervals terminating. Preferably the processor means includes mathematical integration means for use in processing the signals from the arrangement.

Preferably the core orientation device includes means for inputting a selected time interval and means for relating the selected time interval to at least a portion of the processed data stored in the memory. Preferably the core orientation device includes means for using the portion of processed data to establish the measure of the orientation of the device, and means for displaying the measure to a user.

According to another aspect of the invention there is provided an orientation device for providing an indication of the orientation of a core sample relative to a body of material from which the core has been extracted, the orientation device comprising means for determining and storing the orientation of the device at predetermined time intervals relative to a reference time, means for inputting a selected time interval, means for relating the selected time interval to one of the predetermined time intervals and providing an indication of the orientation of the device at the selected time interval.

Such an orientation device is typically attached to an inner tube assembly of a core drill and is fixed against rotation relative thereto. For this purpose, the orientation device according to the invention preferably includes means for attachment to the inner tube assembly.

Preferably, the orientation device further includes means for comparing the orientation of the device at the selected time interval to the orientation of the device at any subsequent time and providing an indication of the direction in which the device should be rotated in order to bring it into an orientation corresponding to the orientation of the device at the selected time.

According to another aspect of the invention there is provided an orientation device for providing an indication of the orientation of a core sample relative to a body of material from which the core sample has been extracted, the orientation device comprising means for generating signals responsive to the orientation of the device, a processor for receiving the generated signals and for processing the signals to generate orientation data representative of the orientation of the device, means for storing the orientation data at predetermined time intervals, means for inputting a signal representative of a selected time interval to the processor, the processor operating to relate the selected time interval to the predetermined time intervals and output a signal indicative of the orientation of the device at the selected time interval.

Preferably, further data is generated representative of the orientation of the device at any subsequent time and the processor is operable to output a signal to a display means to provide a visual indication of the direction in which the device should be rotated at said subsequent time in order to bring the device into an orientation corresponding to its orientation at the selected time.

According to yet another aspect of the invention there is provided a core drill comprising an inner tube assembly and an orientation device according to any one of the above aspects of the invention.

According to yet another aspect of the invention there is provided a core drill comprising an inner tube assembly and an orientation device according to the second aspect of the invention.

According to yet another aspect of the invention there is provided a method of providing an indication of the orientation of a core sample relative to a body of material from which the core sample has been extracted, the method comprising: drilling a core sample from a body of material with a core drill having an inner tube assembly; recording the orientation of the inner tube at predetermined time intervals with reference to an initial reference time during said drilling; recording the specific time interval beyond the reference time at which the core sample was separated from the body of material; removing the inner tube assembly and core sample contained therein from the body of material; and relating the recorded specific time to the recorded time intervals to obtain an indication of the orientation of the inner tube and consequently the core contained therein at the specific time interval.

Preferably, the method according to the invention is performed using an orientation device attached to the inner tube assembly, the orientation device being in accordance with an aspect of the invention.

BRIEF DESCRIPTION OF THE DRAWINGS

The invention will be better understood by reference to the following description of one specific embodiment thereof as shown in the accompanying drawings in which.

BEST MODE(S) FOR CARRYING OUT THE INVENTION

Figure 1:
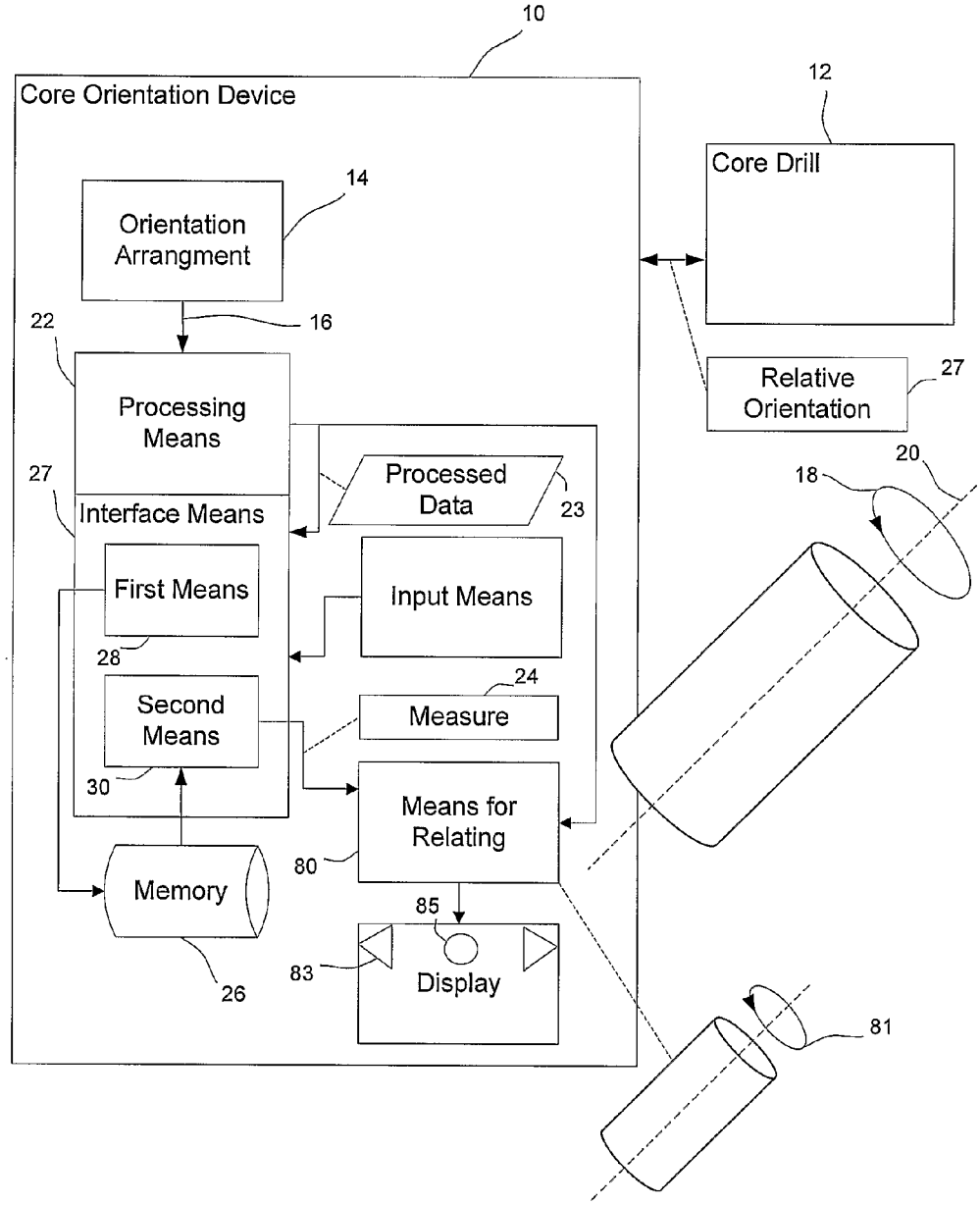
FIG. 1 is a schematic view of a core drill with an orientation device according to the embodiment.

Referring to FIG. 1 there is shown a core orientation device 10 for a core drill 12. The device 10 comprises an arrangement 14 for providing signals 16 associated with a physical orientation of the core orientation device 10. According to the embodiment the physical orientation of the core orientation device 10 comprises rotational orientation 18 about a longitudinal axis 20 of the core orientation device 10.

The core orientation device 10 includes processing means 22 for processing the signals 16 provided by the arrangement 14 so as to provide processed data 23 from which a measure 24 of the rotational orientation 18 of the core orientation device 10 can be established. The measure 24 is associated with the rotational orientation 18 of the device 10 at a particular moment in time.

A memory 26 is coupled to the processing means 22 for storing the processed data 23. To this end there is provided an interface means 27 comprising first means 28 for storing the processed data 23 processed by the processing means 22 in the memory 26 and second means 30 for accessing the memory 26 to provide the measure 24 of the rotational orientation 18 of core orientation device 10. This allows the measure 24 to be obtained when required.

Figure 2:
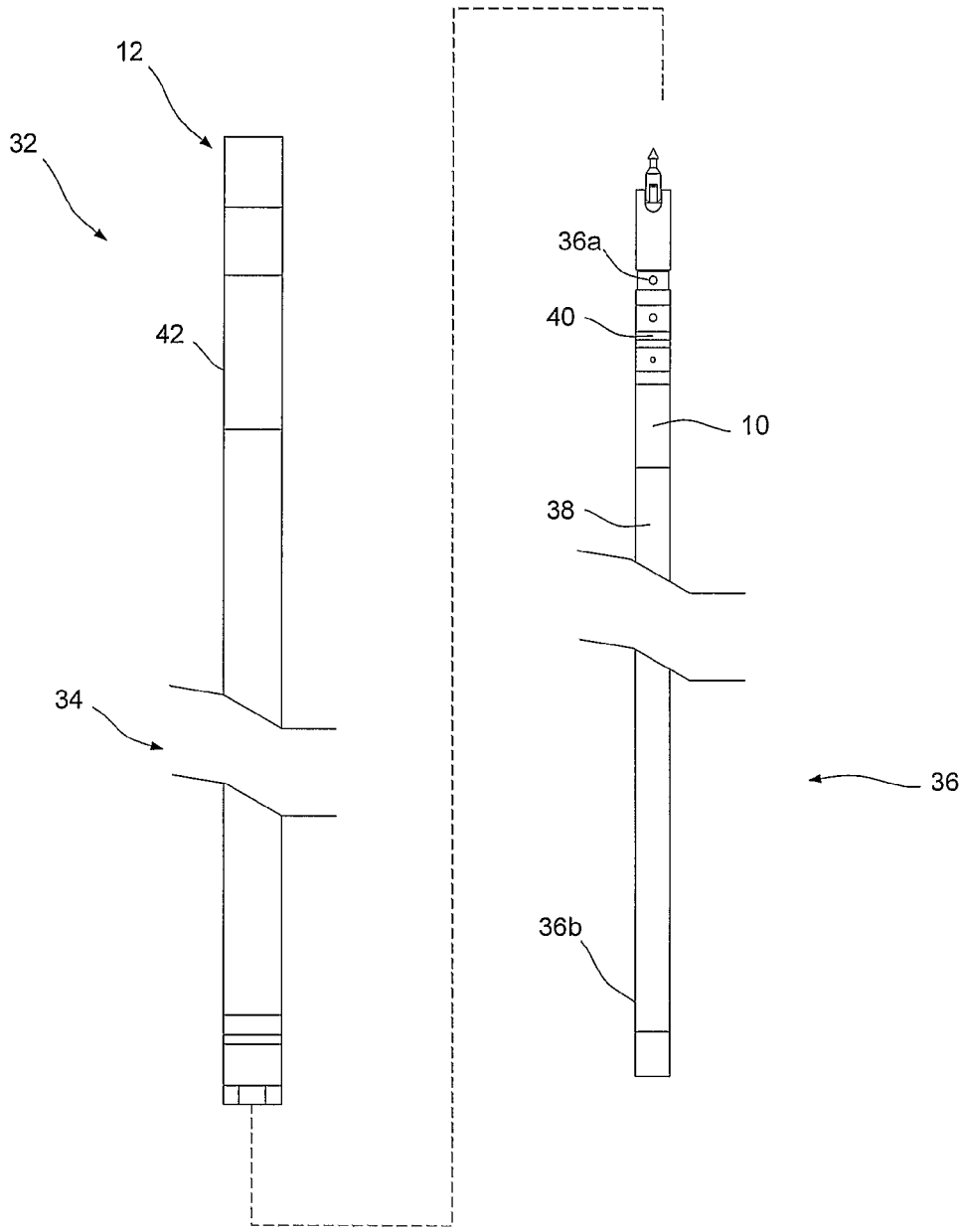
FIG. 2 is a schematic side elevational view of the arrangement shown in FIG. 1.

As shown in FIG. 2 the core drill 12 comprises an outer tube assembly 34 and an inner tube assembly 36 of generally conventional construction.

The orientation device 10 according to the embodiment is accommodated along the length 38 of the inner tube assembly 36, as shown in FIG. 2 of the drawings. In this arrangement the inner tube assembly 36 comprises upper and lower parts 36*a*, 36*b* between which the orientation device 10 is fitted. The upper part 36*a* includes a bearing 40, with the portion above the bearing 40 being rotatable with the outer tube assembly 34 and the portion below the bearing 40 being restrained against rotation because of frictional engagement with the core being generated. Thus, in this manner the bearing 40 allows the core orientation device 10 to rotate relative to the outer tube assembly 34 but not relative to the core sample when the core is received.

Incorporating the orientation device 10 in the inner tube assembly 36 increases the overall length of the inner tube assembly 36, a consequence of which is that the overall length of the outer tube assembly 34 needs to also be increased. A spacer 42 is provided in the outer tube assembly 34 for this purpose. Apart from modifications to the inner tube assembly 36 to accommodate the orientation tool 10, and also the spacer 42 provided in the outer tube assembly 36, the core drill 12 is of conventional construction and operates in a conventional way.

Figure 3:
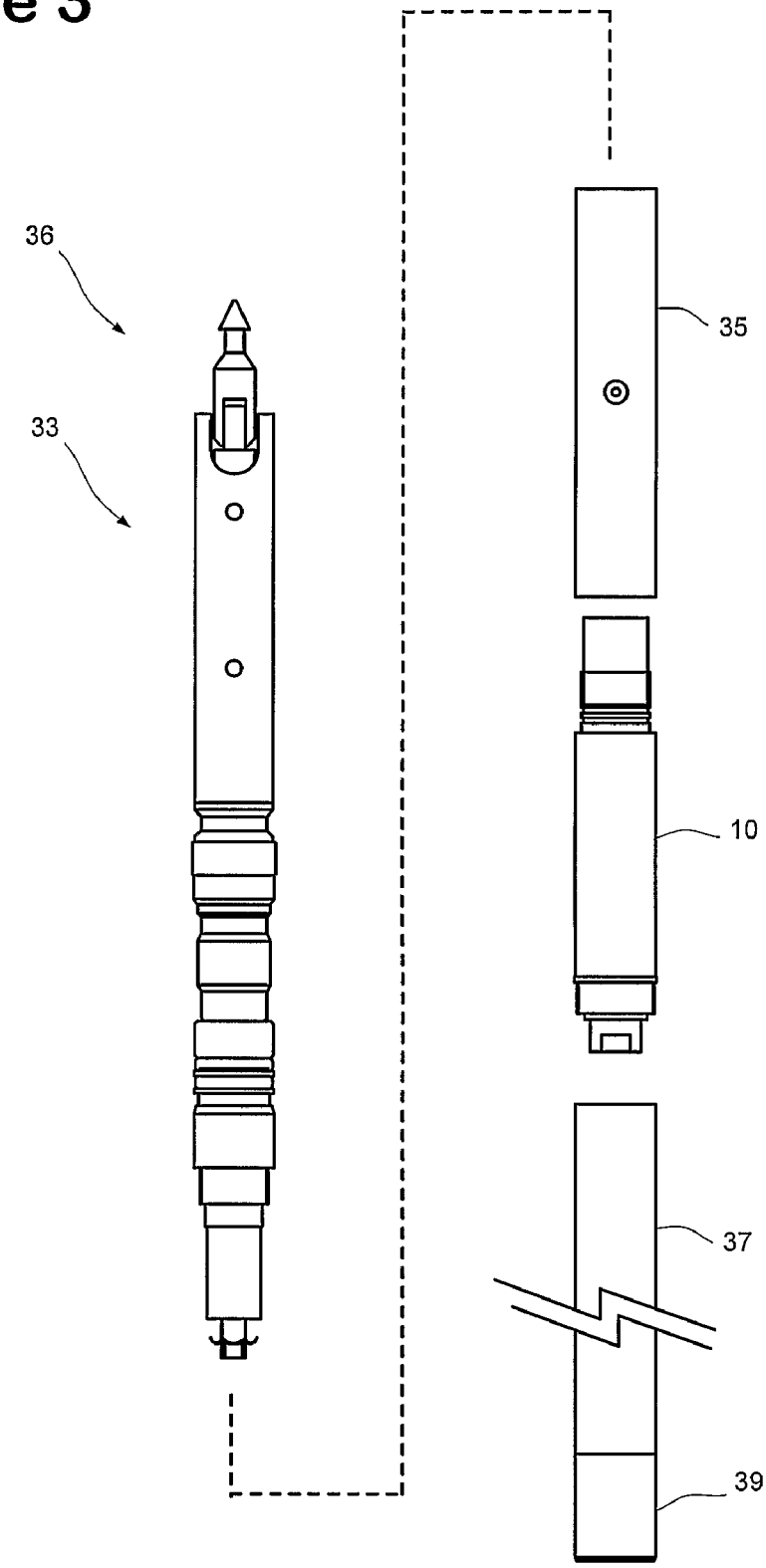
FIG. 3 is a further schematic side elevational view of a lower part of the arrangement shown in FIG. 2.

Referring to FIG. 3 it can be seen that the inner tube assembly 36 comprises a back end assembly 33, a replacement grease sub 35, the core orientation device 10, 3 m of inner tube 37 and core lifter case 39.

Figure 4:
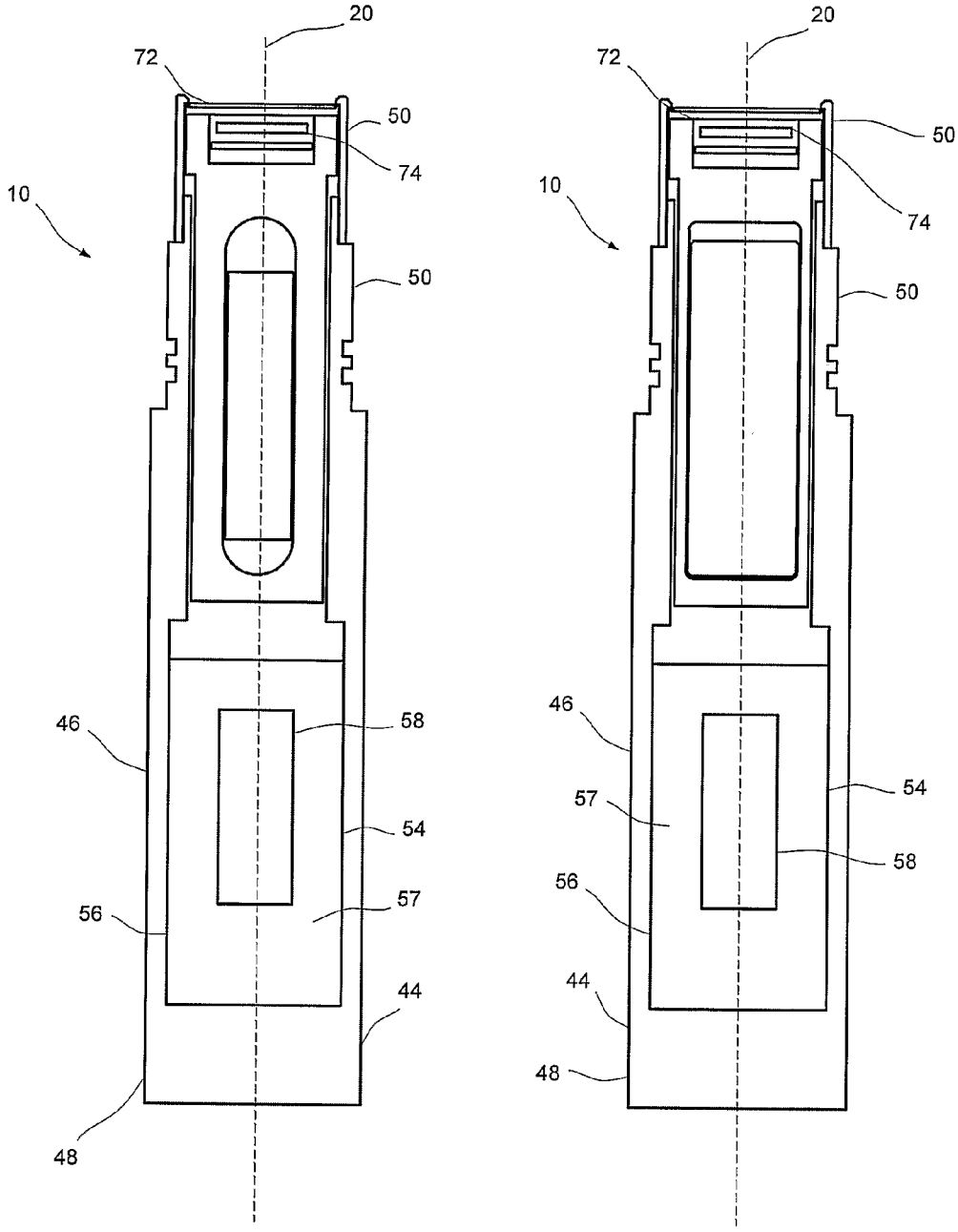
FIG. 4 is a schematic side elevational view in section of the orientation device.

As shown in FIG. 4, the orientation device 10 comprises a housing 44 of generally cylindrical construction thereby defining the central longitudinal axis 20. The housing 44 has a generally cylindrical side wall 46 and two opposed ends 48, 50. The end 48 is open and internally threaded to provide a female threaded formation (not shown). A male threaded formation 52 is provided on the cylindrical side 46 of the housing 40 inwardly spaced from the other end 50.

The female threaded formation (not shown) and the male threaded formation 52 are provided so that the orientation device 10 can be installed between, and in threaded engagement with, the upper and lower parts 36*a*, 36*b* of the inner tube assembly 36, as shown in FIG. 2. The inner tube assembly 36 accordingly has complementary threaded portions (not shown) which provide means for accommodating the core orientation device 10 along the length of the inner tube assembly 36.

The housing 44 accommodates an internal chassis 54.

The chassis 54 has a cavity 56 which accommodates shock absorbing material 57 encasing a triaxial accelerometer means 58.

The shock absorbing material 57 comprises several layers of cushioning. Specifically, there is an outer cushioning layer, an intermediate cushioning layer, and an inner cushioning layer which embraces the triaxial accelerometer means 58, with the robustness of cushioning progressively decreasing from the outer layer to the inner layer.

Figure 5:
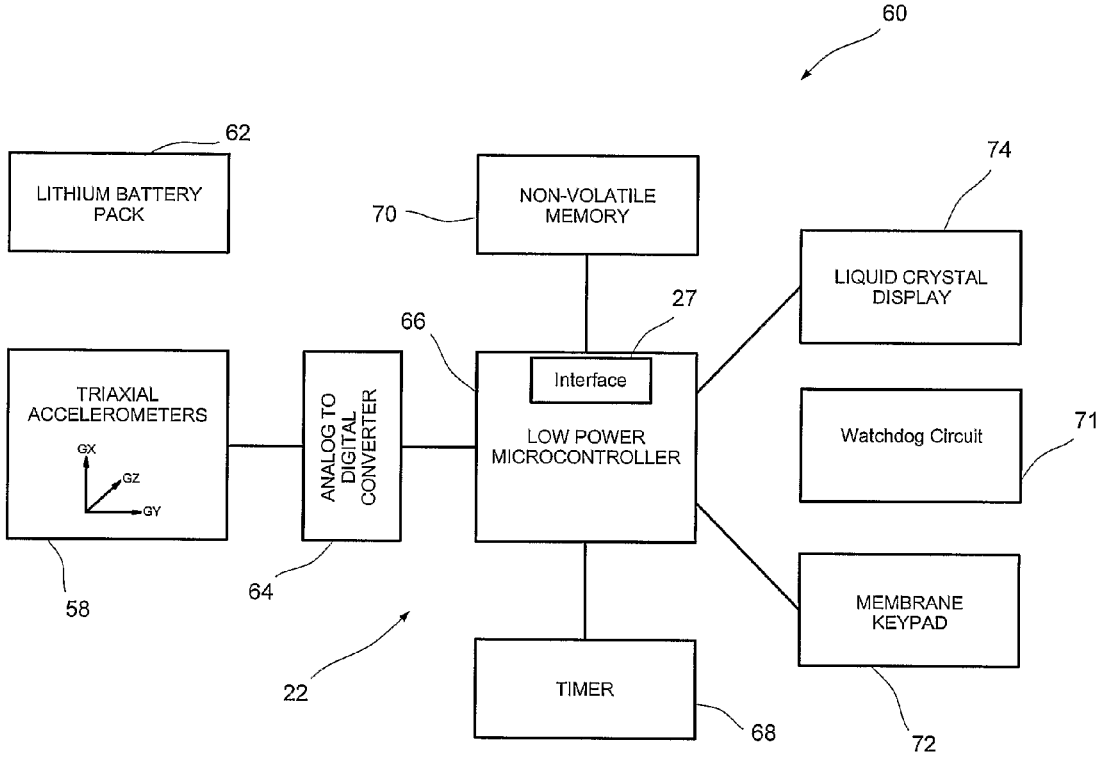
FIG. 5 is a block diagram illustrating various components of the orientation device.

As shown in FIG. 5, the housing 44 also accommodates a main printed circuit board 60 and an electrical power source 62 in the form of a lithium battery pack. The processing means 22 comprises an electronic circuit with chip on the main printed circuit board 60. The processing means 22 incorporates an analogue-to-digital converter 64, a low-power microcontroller 66 which provides a processor, a timer 68 and non-volatile memory 70, as illustrated schematically in FIG. 6. Thus in this embodiment the memory 26 forms part of the processing means 22.

The interface means 27 forms part of the processing means 22 while having the first means 28 for storing the processed data 23 and second means 30 for accessing the memory 26 to provide the measure 24 of the rotational orientation 18 of core orientation device 10 at the associated time. A watchdog circuit 71 is provided for watching the system. In instances where the device 10 shuts down downhole it can be reset at the surface.

The triaxial accelerometer means 58 comprises three internal silicon accelerometers operating along orthogonal directions X, Y and Z. The three accelerometers measure components of the earth's gravitational field.

Mathematically transforming the outputs from the three accelerometers allows the rotational orientation 18 of the device 10 about its longitudinal axis 20 to be determined.

More particularly, the signals 16 produced by the triaxial accelerometer means 43 are determinative of the change in orientation of the device 10 and are transmitted to the analogue-to-digital converter 64 which in turn transmits signals or signal data, to the microcontroller 66.

The timer 68 is provided for ensuring that the processing means processes signals from the arrangement over predetermined time intervals. In this arrangement the processor means 22 includes integration means for integrating signals over a particular predetermined time interval of 1 minute.

When orientation device 10 is operating, the relative orientation of the device is determined at regular intervals as determined by processing means 22. The processing means 22 employs the interface means 27 and second means 30 to store the processed data 23 in memory 26. In this embodiment, the time intervals at which the orientation is determined and stored comprises intervals of one minute. In this way, there is a stored record of the orientation of the device 10 at minute intervals. The orientation of the orientation device 10 of course corresponds to the orientation of the lower part 36*b* of the inner tube assembly 36 which in turn corresponds to the orientation of a core sample progressively entering the inner tube assembly 36, as the lower part 36*b* does not rotate relative to the core sample.

The following process occurs in the operation of the core orientation device 10 and the core drill 12. A first step comprises moving the core drill 12 having the core orientation device 12 forming part thereof from a first location to a drilling location. After this the core drill 12 is operated to drill a core sample.

While the core drill is moved from the first location to the drilling location the core orientation device 10 generates acceleration signals 16 associated with the rotational orientation 18 of a core orientation device 10. The processing means 22 then processes the signals 16 to provide processed data 23 from which the measure 24 of rotational orientation 18 of the device 10 at the drilling location can be established. The processed data 23 is stored in memory 26 for later recall such that the measure 23 of the rotational orientation 18 of the device 10 can be obtained therefrom.

By using integration means and time intervals of one minute the processed data 23 is indicative of the change orientation of the device 10 in one minute intervals commencing from a reference time that corresponds to the time at which the orientation device 10 was started.

Figure 6:
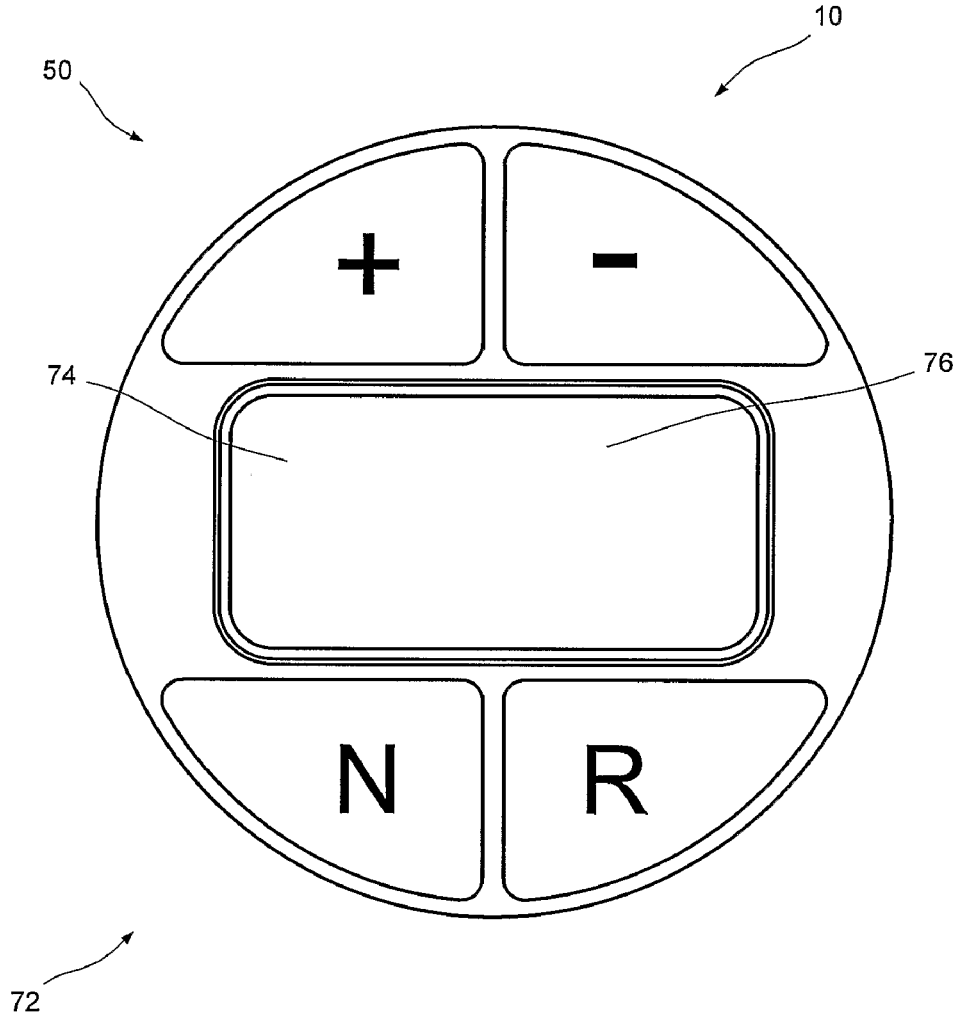
FIG. 6 is a schematic plan view of a keypad and display provided at one end of the orientation device.

As shown in FIG. 6, the core orientation device includes a membrane keypad 72 and an LCD display 74, both of which are provided at end 50 of the orientation device 10. With this arrangement, the keypad 72 is accessible for operation from the end 50 and the display 74 is also visible from that end, but of course only when the orientation device 10 is not connected to upper part 36*a* of the inner tube assembly 36. The keypad 72 incorporates a window section 76 through which the LCD display 74 is visible. The keypad 72 has four keys in this embodiment, identified in FIG. 4 as "N", "R", "+" and "–" keys.

As will be appreciated the membrane keypad 72 and 74 are protected by the inner tube assembly 36 when accommodated in the female threaded portion (not shown).

In this embodiment, the orientation device 10 is started by pressing the "N" key on the keypad 72. It is also necessary to record the time duration between starting the core orientation device 10 and extracting the core sample. Typically this is achieved by starting an external stop watch at the time of starting of the orientation device 10. Other arrangements are of course possible.

The stop watch is started at the time that the orientation device 10 displays a signal on the display 31 indicating that operation of the orientation device 10 has started. This provides for added accuracy.

Once the orientation device 10 has been started and recording of the subsequent time duration commenced, the inner tube assembly 36 is inserted into a drill hole for reception in the outer tube assembly 13, and the core drilling operation commenced. During the drilling operation, a core is progressively generated within the inner tube assembly, as previous explained.

When the core is to be extracted, the core drill operator refers to the timer and notes the time duration involved. Specifically, the operator either notes the full minute that has previously elapsed or waits until the next full minute elapses, and then records that time (as it must be recalled later). The operator then initiates the procedure for breaking the core from the body of material, ensuring that no rotation of the inner tube assembly 36 occurs. The inner tube assembly 36 is retrieved from the drill hole in the conventional manner.

At the surface, the upper part 36*a* of the inner tube assembly 36 is unscrewed from the orientation device 10, so as to the expose the end 50 thereof to provide access to the keypad 72 and display 74. As previously described the frictional engagement of the core and the inner tube assembly 36*b* along with bearing 40 allows the lower part 36*b* to rotate relative to the outer tube assembly 34 but not relative to the core sample.

As will be described the device 10 includes means 80 for relating the measure of the orientation of the core orientation device 10 with the current rotational orientation thereof. This allows for the core orientation device to consequently be rotated to reflect the measure of the orientation of the core orientation device. In this embodiment this is achieved by inputting the time duration as measured by the external stop watch into the the orientation device 10 through the keypad 72. This is done by pressing the "R" key to display numbers "00", and then pressing the ±keys to display the relevant time duration in minutes.

Once the time has been entered, the key "R" is pressed once. This causes the means 80 for relating the core orientation device to the current rotational orientation thereof, to determine a current rotational orientation 81 from processing means 22 and display a graphical indication 83 of the direction in which the orientation device 10 and the lower part 36*b* of the inner tube assembly 36 attached thereto should be rotated. Rotating the device and lower part 36*b* in this direction causes the core contained within the inner tube assembly 36*b* to move into an orientation corresponding to its orientation at the time that it was in the ground before extraction. At this time a symbol 85 is displayed to alert the operator.

Once the required orientation has been established, the core sample within the inner tube assembly 36 can be marked as necessary. After removal of the core sample from the lower part 36*b* of the inner tube assembly 36, the upper part 36*a* can be fitted onto the orientation device 10 and the inner tube assembly 36 used for the next core sample drilling stage.

The process by which the orientation device 10 determines and provides a graphical indication of the direction in which it should be rotated, together with the lower part 15*b* of the inner tube assembly 36 attached thereto, in order to be at an orientation corresponding to the orientation of the core sample in its original position within the ground, operates on the following basis. The time measurement measured by the operator and entered into the keypad 72 represents the duration of time between starting the orientation device 10 and the point at which the particular drilling process was terminated in order to fracture the core sample from the body of material to which it is attached so that the core sample could be retrieved from the drill hole and brought to surface level.

As previously explained, the orientation of the orientation device 10 is determined at predetermined intervals, which are minute intervals in this embodiment. The timer simply allows identification of the particular minute interval at which the appropriate orientation reading was taken and recorded.

Inputting the time measurement into the keypad 72 allows the controller 66 to compare the inputted reading to the various stored readings and identify the relevant orientation reading. The triaxial accelerometer means 58 provides signals responsive to the orientation of the orientation device 10 at any instant in time, including when operating at surface level. Such signals allow the controller 66 to process the signals and determine the orientation of the device at any instant. The controller 53 can compare the instant of the device at surface level at any instant in time to the particular recorded reading corresponding to the orientation of the device at the time that the core sample was separated from the body of material to which it was previously attached. This comparison is processed to provide data which is outputted to the display 74 to provide a visual indication of the direction in which the orientation device should be rotated, as previously explained.

In this embodiment, the visual indication comprises a directional arrow arrangement showing the required rotational direction. Once the orientation device 10 is at the required orientation, the display 74 provides an image 85 representing that condition.

From the forgoing, it is evident that the present invention provides an orientation device which does not require physical marking of a core sample prior to extraction thereof from the ground. Indeed, the orientation device according to the embodiment is particularly convenient for an operator to use. All that is required is for the operator to start the orientation device prior to the inner tube assembly 36 being inserted into the drill hole, and contemporaneously start a timer for recording the time duration before the drilling operation ceases to allow the generated core sample to be retrieved.

Modifications and improvements may be made without departing from the scope of the invention. For example in other embodiment the physical orientation does not comprise a rotational orientation but rather a measure of degrees above or below the horizontal plane.

Throughout the specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A core orientation device for a core drill, the core orientation device comprising:

an arrangement for providing signals associated with a rotational orientation of the core orientation device;

means for maintaining a rotational orientation of a core drilled by the core drill stationary with respect to the rotational orientation of the core orientation device:

processing means for processing the signals provided by the arrangement so as to provide processed data from which a measure of the physical orientation of the core orientation device can be established, the measure being associated with the rotational orientation of the core orientation device at a particular moment in time;

memory for storing the processed data;

interface means having first means for storing the processed data in the memory and second means for accessing the memory to provide the measure of the rotational orientation of core orientation device when required; and means for relating the measure of the rotational orientation of the core orientation device with the present rotational orientation thereof such that the core orientation device can be rotated so that the core reflects the measure of the rotational orientation of the core orientation device.

2. A core orientation device as claimed in claim 1, wherein the arrangement for providing signals comprises triaxial accelerometer means.

3. A core orientation device as claimed in claim 1, wherein the core orientation device includes input means for inputting the particular moment in time into the processing means and display means for subsequently displaying the measure of the rotational orientation of the core orientation device, the measure being associated with the inputted moment in time.

4. A core orientation device as claimed in claim 3 wherein the core orientation device is cylindrical and one end of the core orientation device includes the display and input means in the form of a LCD display and keypad.

5. A core orientation device as claimed in claim 1, wherein the core orientation device has a body in the form of a housing having at least one threaded end for being engaged by an inner tube assembly of the core drill.

6. A core orientation device as claimed in claim 5 wherein, when engaged by the inner tube assembly, the core orientation device forms a length of the inner tube assembly.

7. A core orientation device as claimed in claim 1, wherein the processing means includes a timer configured for ensuring that the processing means processes signals from the arrangement over predetermined time intervals.

8. A core orientation device as claimed in claim 1, wherein the processor means includes integration means for integrating signals from the arrangement over a predetermined time interval.

9. A core orientation device as claimed in claim 1, wherein the processor means includes timer means for determining predetermined intervals relative to a reference time, and means for storing the processed data in the memory upon each of the predetermined intervals terminating.

10. A core drill having a core orientation device comprising: an arrangement for providing signals associated with a rotational orientation of the core orientation device;

processing means for processing the signals provided by the arrangement so as to provide processed data from which a measure of the rotational orientation of the core orientation device can be established, the measure being associated with the rotational orientation of the core orientation device at a particular moment in time;

memory for storing the processed data; and interface means having first means for storing the processed data in the memory and second means for accessing the memory to provide the measure of the rotational orientation of core orientation device when required;

wherein the core drill comprises:

means for maintaining a rotational orientation of a core drilled by the core drill stationary with respect to the rotational orientation of the core orientation device; and means for relating the measure of the rotational orientation of the core orientation device with the present rotational orientation thereof such that the core orientation device can be rotated so that the core reflects the measure of the rotational orientation of the core orientation device.

11. A core drill as claimed in claim 10 wherein the means for maintaining a rotational orientation of the core drill stationary with respect to the rotational orientation of the core orientation device comprises a mechanism for preventing rotational movement about the length of the core drilled by the core drill. relative to the core orientation device.

12. A core drill as claimed in claim 10, wherein the core drill includes an outer tube assembly and an inner tube assembly with the inner tube assembly having a means for accommodating the core orientation device along the length of the inner tube assembly.

13. A core drill as claimed in claim 12 wherein the inner tube assembly includes a bearing allowing the means for accommodating the core orientation device to rotate relative to the outer tuber assembly but not relative to the core when the core is received by the inner tube assembly.

14. A core drill as claimed in claim 12 wherein the core orientation device is cylindrical and one end of the core orientation device includes display and input means in the form of a LCD display and keypad, the end of the core orientation device being protected by the inner tube assembly when accommodated.

15. A core drill as claimed in claim 12, wherein the outer tube assembly includes a spacer for allowing the inner tube assembly to be fitted with the outer tube assembly when the core orientation device is accommodated.

16. A method of obtaining and orientating a core sample comprising:

moving a core drill having a core orientation device from a first location to a drilling location and thereafter operating the core drill to drill a core;

maintaining a physical orientation of the core stationary with respect to a physical orientation of the core orientation device;

generating signals associated with the physical orientation of the core orientation device between the first location and the drilling location;

processing the signals to provide processed data from which a measure of the physical orientation of the core orientation device at the drilling location can be established;

storing the processed data in memory such that the measure of the physical orientation of the core orientation device can be obtained therefrom; and displaying a related measure of the physical orientation of the device and varying that related measure upon rotation of the core orientation device such that a user can position the core in the measured physical orientation for marking.

17. A method as claimed in claim 16 wherein the method includes maintaining knowledge of the relative physical orientation of the core orientation device and of the core after the core has been drilled such that a measure of the physical orientation of the core taken by the core drill can be provided using the measure of the physical orientation of the core orientation device when at a location spaced from the drilling location.

18. A method as claimed in claim 16 wherein the method includes initialising the physical orientation of the core orientation device at the first location, said initialising being performed by commencing said generating and processing the signals at the first location with the core orientation device in a known physical orientation.

19. An orientation device for providing an indication of a rotational orientation of a core relative to a body of material from which the core has been extracted, the orientation device comprising:

means for maintaining the rotational orientation of the core stationary with respect to a rotational orientation of the orientation device;

means for determining and storing the rotational orientation of the orientation device at predetermined time intervals relative to a reference time;

means for inputting a selected time interval;

means for relating the selected time interval to one of the predetermined time intervals and providing an indication of the rotational orientation of the core orientation device at the selected time interval; and means for comparing the rotational orientation of the orientation device at the selected time interval to the rotational orientation of the orientation device at any subsequent time and providing an indication of the direction in which the orientation device should be rotated in order to bring the core into a rotational orientation corresponding to the rotational orientation of the core at the selected time.

20. An orientation device as claimed in claim 19 attached to an inner tube assembly of a core drill and fixed against rotation relative thereto, the physical orientation device including means for attachment to the inner tube assembly.

21. An orientation device for providing an indication of the rotational orientation of a core relative to a body of material from which the core has been extracted, the orientation device comprising:

means for maintaining the rotational orientation of the core stationary with respect to a rotational orientation of the orientation device;

means for generating signals responsive to the rotational orientation of the orientation device;

a processor for receiving the generated signals and for processing the signals to generate orientation data representative of the rotational orientation of the orientation device;

means for storing the orientation data at predetermined time intervals; and means for inputting a signal representative of a selected time interval to the processor, the processor operating to relate the selected time interval to the predetermined time intervals and output a signal indicative of the rotational orientation of the core device at the selected time interval;

wherein, the orientation data is generated representative of the rotational orientation of the orientation device at any subsequent time and the processor is operable to output a signal to a display means to provide a visual indication of the direction in which the orientation device should be rotated at said subsequent time in order to bring the core into a rotational orientation corresponding to its rotational orientation at the selected time.

22. A method of providing an indication of a rotational orientation of a core relative to a body of material from which the core has been extracted, the method comprising:

drilling a core from a body of material with a core drill having an inner tube assembly adapted to receive the core;

maintaining the rotational orientation of the core stationary with respect to a rotational orientation of the inner tube assembly;

recording the rotational orientation of the inner tube assembly at predetermined time intervals with reference to an initial reference time during said drilling;

recording the specific time interval beyond the reference time at which the core sample was separated from the body of material;

removing the inner tube assembly and core contained therein from the body of material; and relating the recorded specific time to the recorded time intervals to obtain an indication of the rotational orientation of the inner tube assembly and consequently the core contained therein at the specific time interval.

23. A method according to claim 22 further comprising the steps of rotating the inner tube assembly so that the rotational orientation of the core reflects the rotational orientation of the core at the time interval when the core was separated from the body of material.

* * * * *